United States Patent [19]

Sanders, Jr. et al.

[11] Patent Number: 5,040,911

[45] **Date of Patent: * Aug. 20, 1991**

[54] PAPER ADVANCING SYSTEM FOR HIGH SPEED PRINTERS

[75] Inventors: Royden C. Sanders, Jr., Pine Valley Mill, P.O. Box 550, Wilton, N.H. 03086; John L. Forsyth, Greenfield, N.H.

[73] Assignee: Royden C. Sanders, Jr., Wilton, N.H.

[ * ] Notice: The portion of the term of this patent subsequent to Jan. 30, 2007 has been disclaimed.

[21] Appl. No.: 459,805

[22] PCT Filed: Aug. 9, 1989

[86] PCT No.: PCT/US89/03411

§ 371 Date: Apr. 10, 1990

§ 102(e) Date: Apr. 10, 1990

[87] PCT Pub. No.: WO90/01416

PCT Pub. Date: Feb. 22, 1990

Related U.S. Application Data

[63] Continuation-in-part of Ser. No. 230,457, Aug. 10, 1988, Pat. No. 4,896,980.

[51] Int. Cl.[5] ..... B41J 11/26

[52] U.S. Cl. ..... 400/618

[58] Field of Search ..... 400/616.1, 616.3, 636.2, 400/636, 618, 613.3, 551; 271/256, 257; 226/74, 75

[56] References Cited

U.S. PATENT DOCUMENTS

| | | | |
|---|---|---|---|
| 3,259,288 | 7/1986 | Wassermann | 400/618 |
| 3,568,812 | 3/1971 | Eitel | 400/618 |
| 3,572,601 | 3/1971 | Miller | 400/618 |
| 3,586,149 | 6/1971 | Miller | 400/618 |
| 3,653,482 | 4/1972 | Cortune et al. | 400/618 |

(List continued on next page.)

FOREIGN PATENT DOCUMENTS

| | | | |
|---|---|---|---|
| 413760 | 5/1946 | Italy | 226/76 |
| 144779 | 9/1982 | Japan | 400/616.1 |
| 173185 | 10/1982 | Japan | 400/616.1 |
| 102787 | 6/1983 | Japan | 400/616.1 |
| 194964 | 11/1984 | Japan | 226/76 |

OTHER PUBLICATIONS

IBM Tech. Disc. Bulletin "Preventing The Jamming of the Paper in a Printer Due to Buckling" vol. 30; No. 2, 7/82; pp. 623–624.

IBM Tech Disc. Bulletin; "Forms-Loading Mechanism", vol. 23; No. 8, 1/81; pp. 3538–3539.

*Primary Examiner*—Eugene H. Eickholt

*Attorney, Agent, or Firm*—Davis, Bujold & Streck

[57] ABSTRACT

A method and associated apparatus for quickly and accurately advancing paper between the platen and printing mechanism on a line-by-line basis in a high speed printer for printing lines of text including a platen and a printing mechanism disposed adjacent the platen. The method comprises the steps of, threading the paper from the supply input through a powered first drive mechanism disposed before the platen and printing mechanism, through a frictional gripping mechanism disposed adjacent the platen between the platen and the first drive mechanism and adapted for frictionally gripping the paper under a gripping force sufficient to prevent advancement beyond the frictional gripping mechanism by a pushing force on the paper while permitting the paper to be pulled through the frictional gripping mechanism by a second drive mechanism, between the platen and printing mechanism and into engagement with a powered second drive mechanism disposed after the platen and printing mechanism and adapted for gripping and rapidly moving the paper a feed distance; using the powered first drive mechanism to receive the paper and advance at least one dot line feed distance of paper to form a supply loop between the powered first drive mechanism and the frictional gripping mechanism; and, at the time for advancing the paper by the feed distance, which may be while the first drive mechanism is still operating, using the powered second drive mechanism to pull the paper through the frictional gripping mechanism the feed distance from the supply loop.

9 Claims, 6 Drawing Sheets

U.S. PATENT DOCUMENTS

| | | | |
|---|---|---|---|
| 3,746,142 | 7/1973 | Herp et al. | 400/618 |
| 3,799,314 | 3/1974 | Smith | 400/618 |
| 3,802,546 | 4/1974 | Helms | 400/618 |
| 4,072,225 | 2/1978 | Manning et al. | 400/618 |
| 4,295,912 | 10/1981 | Burns | 226/76 |
| 4,345,708 | 8/1982 | Hubbard | 226/75 |
| 4,348,118 | 9/1982 | Suafverstett et al. | 400/618 |
| 4,368,994 | 1/1983 | Sweeney | 400/636.2 |
| 4,488,367 | 12/1984 | Yamauchi et al. | 400/636 |
| 4,593,293 | 6/1986 | Higa | 226/76 |
| 4,651,173 | 3/1987 | Ozawa et al. | 400/616.3 |
| 4,721,297 | 1/1988 | Katayama | 400/636.2 |
| 4,896,980 | 1/1990 | Sanders, Jr. et al. | 400/618 |

PRIOR ART

MAX CARRIAGE SPEED FOR 1/60" REFIRE 46.67"/SEC
MAX PRINTHEAD REFIRE RATE 2800 HZ
SPACING BETWEEN PIN AND SINGLE PIN PRINT LINE 0.8333"
PRINT LINE 13.333"

PAPER ADVANCING SYSTEM FOR HIGH SPEED PRINTERS

This is a continuation-in-part of copending application Ser. No. 230,457 filed on Aug. 10, 1988, now U.S. Pat. No. 4,896,980.

BACKGROUND OF THE INVENTION

The present invention relates to paper feeders for computer-driven printers, and the like, and, more particularly, to high speed paper advancing apparatus for moving paper on a line-by-line basis from a supply input between the platen and printing mechanism in a printer printing lines of text and including a platen and a printing mechanism disposed adjacent the platen comprising, powered lower drive means disposed below the platen and printing mechanism for receiving the paper from the supply input and for forming a supply loop containing paper for at least one dot line feed distance between the powered lower drive means and the platen and printing mechanism; powered upper drive means disposed above the platen and printing mechanism for gripping and rapidly moving the paper the feed distance from the supply loop between the powered lower drive means and the platen and printing mechanism; and, control logic means operably connected to the powered lower drive means and the powered upper drive means for causing the lower drive means to receive the paper from the supply input and form the supply loop during the time the printing apparatus is printing a line and for causing the upper drive means to move the paper from the supply loop the feed distance when the printing apparatus has completed printing a line and requires the paper to be advanced the feed distance in order to print a next line.

Most high speed alphanumeric printers used in association with computers to be driven thereby employ so-called "fanfold" or continuous paper having removable edges on either side containing equally spaced drive holes therein. A so-called "tractor feed" mechanism is then employed to pull the paper through the printer. A typical prior art approach to paper advancing with a tractor feed mechanism is depicted in FIGS. 1 and 2.

As can be seen, a driven tractor feed 10 is placed on either side of the paper 12 so that the drive pegs 14 engaged the holes 16 in the removable edges 18 of the paper 12. The paper is fed upward vertically from a supply stack (not shown), between the print station 20 and platen 22, and over the tractor feeds 10. The print station 20 can comprise a dot matrix printhead, a shuttle printhead, a "daisywheel" printhead, or the like. The paper is typically held against the pegs 14 of the tractor feeds 10 with a spring-loaded pressure grip (not shown). Typically, one roller 24 of one of the tractor feeds 10 is connected to the platen 22 by a gear train (symbolized by the dashed line 26) to be driven in combination therewith. The other roller 28 over which the tractor belt 30 is stretched is an idler roller. The two drive rollers 24 are interconnected by a shaft. Thus, as the platen 22 is moved in the "line feed" mode, the two drive rollers 24 are rotated. This, in turn, rotates the tractor belt 30 which pulls the paper 12 up to the proper position for printing the next line of text.

Tractor feed systems such as that shown in FIGS. 1 and 2 work reasonably well for slow speed operation. As long as the sequence of operation for paper advancement as described above take place slowly enough, the starting torque requirements placed on the platen drive motor (not shown) are low and sufficient power can be developed to pull the span of paper 12 extending downward (under the effects of gravity and friction) from the tractor feeds 10 to the supply stack. In slow speed operation, there is a virtual constant "downward" pressure on all the components and clearances provided to prevent binding of parts and occurring naturally from wear to not cause problems. Likewise, the concept of "braking" and "overshoot" are meaningless. In high speed operation, however, these previously ignorable factors suddenly take on monumental proportions leading to non-operability of the paper advancing system. As can be appreciated by those skilled in the art, the paper advancing system is the potential "weak link" in a high speed printer; that is, if the paper cannot be advanced line-by-line to keep up with the printing mechanism, the printing mechanism must be slowed down below its potential.

When trying to achieve paper advance steps such as 1/72" in 1 ms or 5/72" in 2 ms as is required to meet the printing speed capabilities of certain contemporary shuttle printers, for example, the above-described tractor feed approach of pulling the paper over the platen and past the print station 20 fails dismally. If starting torques sufficient to accelerate the paper 12 to the required speed are applied, the holes 16 can be ripped out of the paper 12 as a result of the high starting inertia of the mass of paper that must be moved each time. With so-called "laser cut" paper where the lightly attached edges 18 are intended to break off smoothly, the edges 18 may just pull off and advance while the paper 12 stays put. Multi-ply paper also causes difficulties because of its mass. In those instances where the paper is brought up to speed without incident, it may not stop in time because of the same high mass (relatively speaking) in motion. Without a positive brake, the paper 12 between the print station 20 and tractor feeds 10 may overshoot slightly and then settle back down to its proper position hanging from the tractor feeds 10. This, of course, can result in a curved line of text with a high point at the beginning.

Wherefore, it is the object of the present invention to provide a paper advancing system for use in high speed printers, and the like, which can advance continuous paper on a line-by-line basis quickly, accurately, and without overshoot, or the like.

Other objects and benefits of the present invention will become apparent from the description which follows hereinafter when taken in conjunction with the drawing figures which accompany it.

SUMMARY

The foregoing objects have been achieved in a printer for printing lines of text including a platen and a printing mechanism disposed adjacent the platen, by the improved paper advancing apparatus of the present invention for moving paper on a line-by-line basis from a supply input between the platen and printing mechanism comprising, powered lower drive means disposed below the platen and printing mechanism for receiving the paper from the supply input and for forming a supply loop containing paper for at least one dot line feed distance between the powered lower drive means and the platen and printing mechanism; powered upper drive means disposed above the platen and printing mechanism for gripping and rapidly moving the paper the feed distance from the supply loop between the powered lower drive means and the platen and printing mechanism; and, control logic means operably connected to the powered lower drive means and the powered upper drive means for causing the lower drive means to receive the paper from the supply input and form the supply loop during the time the printing apparatus is printing a line and for causing the upper drive means to move the paper from the supply loop the feed distance when the printing apparatus has completed printing a line and requires the paper to be advanced the feed distance in order to print a next line.

In one version, the paper is continuous paper and the powered lower drive means comprises a first tractor feed mechanism disposed for lifting the paper from a supply stack and for advancing it ahead of the first tractor feed mechanism and frictional gripping means disposed adjacent the platen between the platen and the tractor feed mechanism for frictionally gripping the paper under a gripping force sufficient to prevent advancement beyond the frictional gripping means by the first tractor feed mechanism while permitting the paper to be pulled through the frictional gripping means by the upper drive means. In the preferred embodiment, the powered lower drive means additionally comprises a first drive motor operably connected to the tractor feed mechanism and the control logic means wherein the first drive motor is a stepping motor.

The preferred frictional gripping means comprises a smooth surfaced guide bar disposed parallel to the platen and a spring metal pressure plate disposed parallel to the guide bar, the pressure plate having a smooth pressure edge which is curved in cross section and bears against the guide to releasably grip the paper therebetween.

The preferred powered upper drive means comprises, a pair of feed rollers mounted for rotation and disposed parallel to the platen adjacent respective side edges of the paper; a pair of pressure idler rollers mounted for rotation and disposed parallel to respective ones of the feed rollers in contacting relationship thereto; means for urging the pressure idler rollers against the feed rollers to create a gripping force therebetween for frictionally gripping the paper under a gripping force sufficient to pull the paper through the frictional gripping means; and, a second drive motor operably connected to the feed roller and the control logic means wherein the second drive motor is a D.C. motor. Preferably, there are also position sensor means for developing a signal reflecting the rotational position of the second drive motor operably connected to the control logic means.

Also in the preferred embodiment, there is an electromagnetic brake disposed between the feed roller and the end of the drive shaft of the second drive motor as well as a backlash coupling mechanism having an arc of freeplay motion disposed between the feed roller and the end of the drive shaft of the second drive motor, wherein the control logic means includes means for backing up the second drive motor to a point towards the beginning of the freeplay during the time the printer is printing a line of text and for starting the second drive motor in a forward direction at a time prior to the time the upper drive means is to move the paper from the supply loop the feed distance such that the freeplay is exhausted exactly at the moment the upper drive means is to move the paper from the supply loop the feed distance.

In an embodiment for use with single sheet paper, the powered lower drive means comprises, a feed mechanism disposed for receiving a sheet of paper from a supply input and for advancing it ahead of the feed mechanism; pressure roller means for holding a sheet of paper against the feed mechanism for advancement thereby; and, frictional gripping means disposed adjacent the platen between the platen and the tractor feed mechanism for frictionally gripping the paper under a gripping force sufficient to prevent advancement beyond the frictional gripping means by the feed mechanism while permitting the paper to be pulled through the frictional gripping means by the upper drive means.

In an alternate embodiment for use with continuous paper, the powered upper drive means comprises a second tractor feed mechanism disposed for gripping the paper and pulling the paper through the frictional gripping means.

DESCRIPTION OF THE PREFERRED EMBODIMENT

Figures 1, 2:
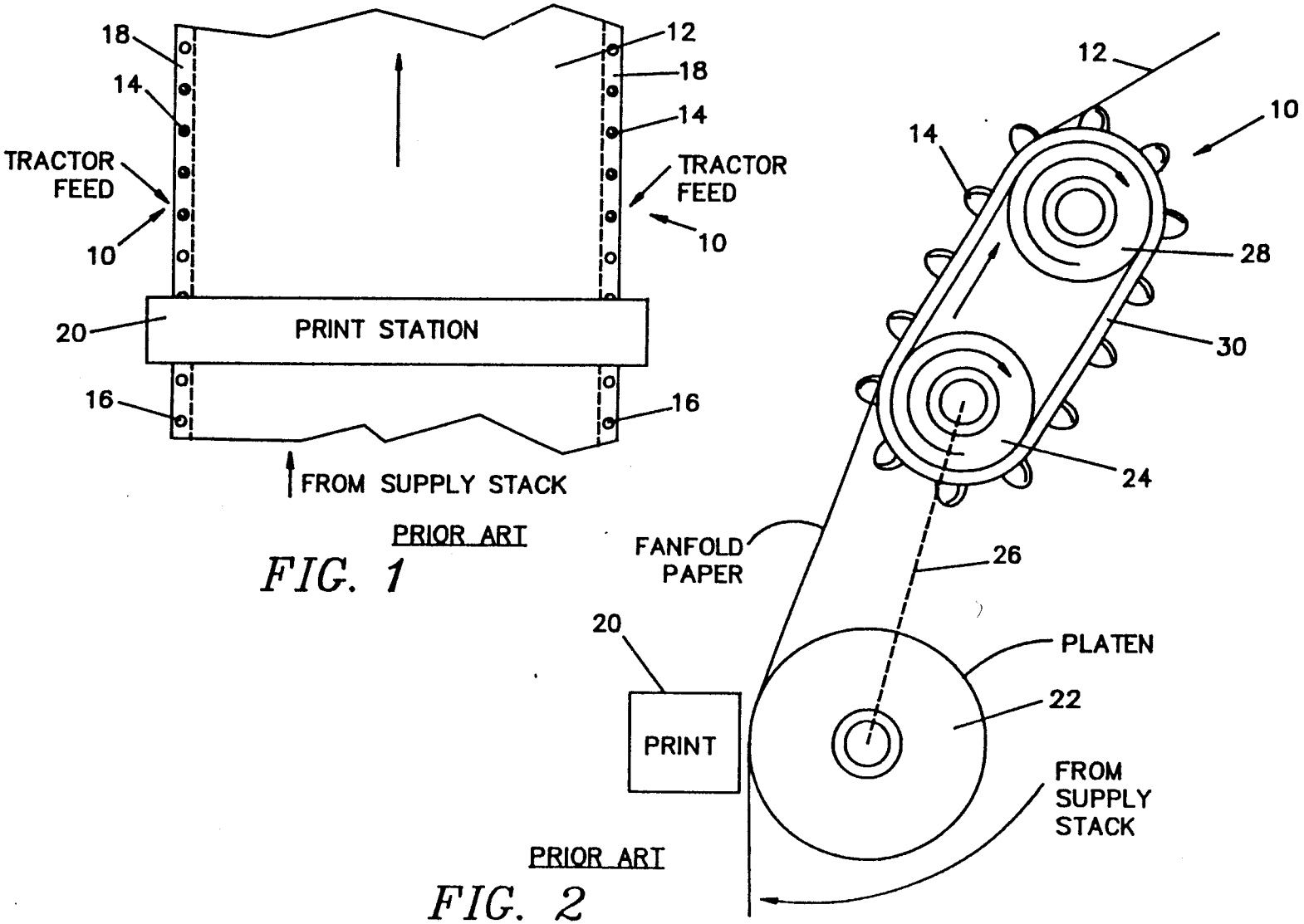
FIG. 1 PRIOR ART
FIG. 1 is a simplified drawing depicting a prior art tractor feed type of paper advancing system.
FIG. 2 is a detailed side view of the tractor feed paper advancing system of FIG. 1.

Before beginning the description of the present invention, the concept of line feed as employed in the description and claims which follow should be clarified. In a high speed dot matrix printer of the shuttle variety as wherein the present invention is primarily intended to be used, a single line of dots may be produced by multiple print heads disposed in side-by-side relationship. After a line is printed, the paper is advanced by "one dot line", which is the distance between vertically spaced dots. This distance is typically in the order of 1/72 inch. The typical "line feed" as thought of in alpha-numeric printing refers to the vertical distance between lines (i.e. rows) of characters. This distance is much larger than the one dot line distance, e.g. typically in the order of 1/6 inch. There is also a "fractional line feed" which is typically in the order of 5/72 inch. While the present invention as described and claimed herein refers to one dot line of paper advancement, the invention could be used with a high speed alpha-numeric printer, in which case the one dot line referred to would, in fact, be one line feed from one line of characters to the next. It is the inventors' intent that the present application and the claims appended thereto be accorded a breadth in keeping with the scope and spirit of the invention as disclosed therein and that they not be limited by the use of particular language with respect to line feeding and the distances traversed by the paper in being so fed.

The present invention is based on the proposition of accomplishing the task of lifting the large mass of paper extending from adjacent its point of use to the supply stack during the extended period of time (relatively speaking) that exists while a line of text is being printed and then moving only a small mass through the line feed distance during the time between lines. This is accomplished by the paper advancing mechanism generally indicated as 32 in FIG. 3. Details of the feed roller drive assembly thereof are shown in FIG. 4. The paper advancing mechanism 32 of the present invention as applied to the printing of continuous, fan fold paper comprises three major components—a tractor feed lifting mechanism, generally indicated as 34, a lower paper guide assembly, generally indicated as 36, and a feed roller assembly, generally indicated as 38.

The tractor feed lifting mechanism 34 comprises a horizontally disposed tractor feed mechanism 10' generally as described above. A pair of drive rollers 24 are located to be on either side of the paper 12. The drive rollers 24 are interconnected by a shaft 40 so as to move in combination. One end of the shaft 40 has a drive gear 42 concentrically mounted thereon. The drive gear 42 is operably connected to be driven by a pinion gear 44 carried by the drive shaft 46 of a lower stepping motor 48. The stepping motor 48 is controlled by control logic 50. Thus, independently and at the proper time (to be described shortly), by stepping the motor 48, the control logic 50 can independently turn the drive rollers 24, tractor belts 30, and idler rollers 28 in combination to lift the paper 12 from the supply stack (not shown) and push it horizontally toward the lower paper guide assembly 36 as indicated by the arrow 52. As will be appreciated by those skilled in the art, other functionally equivalent types of motors could, of course, be employed for the motor 48, e.g. D.C. motors, rotary or linear solenoid motors, etc.

The lower paper guide assembly 36 is fastened adjacent the platen 22'. Note that the platen 22' is a non-rotating bar and not a roller as in the prior art since the present invention is not an adaptation of old typewriter paper feed mechanisms as are most of the prior art paper advancing mechanisms. A smooth surfaced guide bar 54 extends across the width of the platen 22' and parallel thereto just under the printing face 56 thereof. A supplemental bar 58 is positioned below and behind the guide bar 54. In the event of a malfunction, the supplemental bar 58 prevents the paper 12 from lifting off of the drive pegs 14 and moving into parts of the paper advancing mechanism 32 where it should not be. A spring metal pressure plate 60 is disposed parallel to the guide bar 54 across the width of the paper 12. The pressure plate is generally L-shaped in cross section. There is a horizontal portion 62 and a vertical portion 64. The ends of the bars 54 and 58 and the horizontal portion are attached to a pair of end plates 66 by means of which the lower paper guide assembly 36 can be removably and adjustably attached to the sidewalls of a printer such as by cap screws 68. The vertical portion 64 of the pressure plate 60 is free to flex about its lower end 70. The upper edge of the vertical portion 64 terminates in a smooth pressure edge 72 which is curved in cross section. The edge 72 bears against the guide bar 54 and releasably grips the paper therebetween. This will be returned to shortly.

Figure 3:
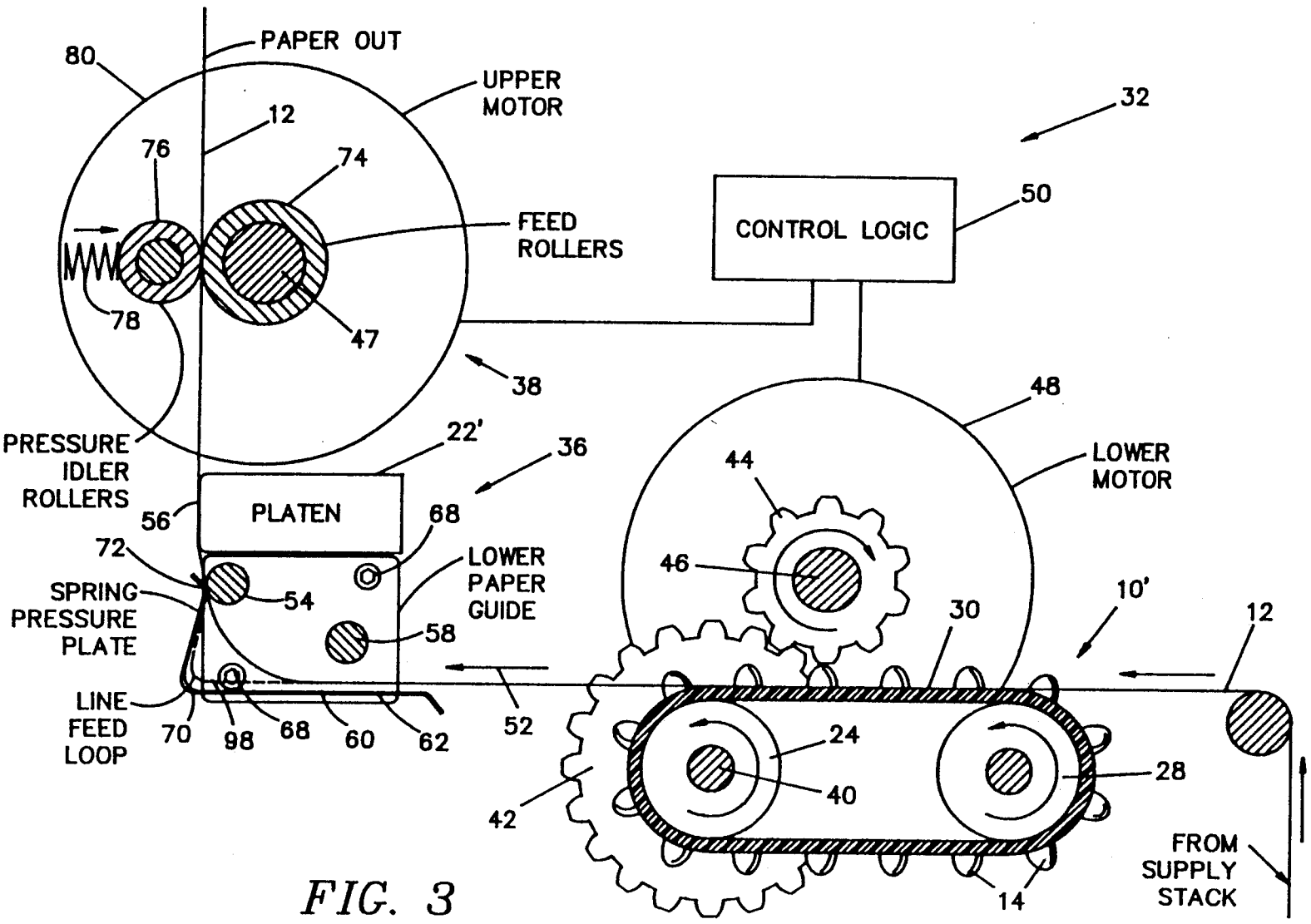
FIG. 3 is a detailed side view of the high speed paper advancing system of the present system.
Figure 4:
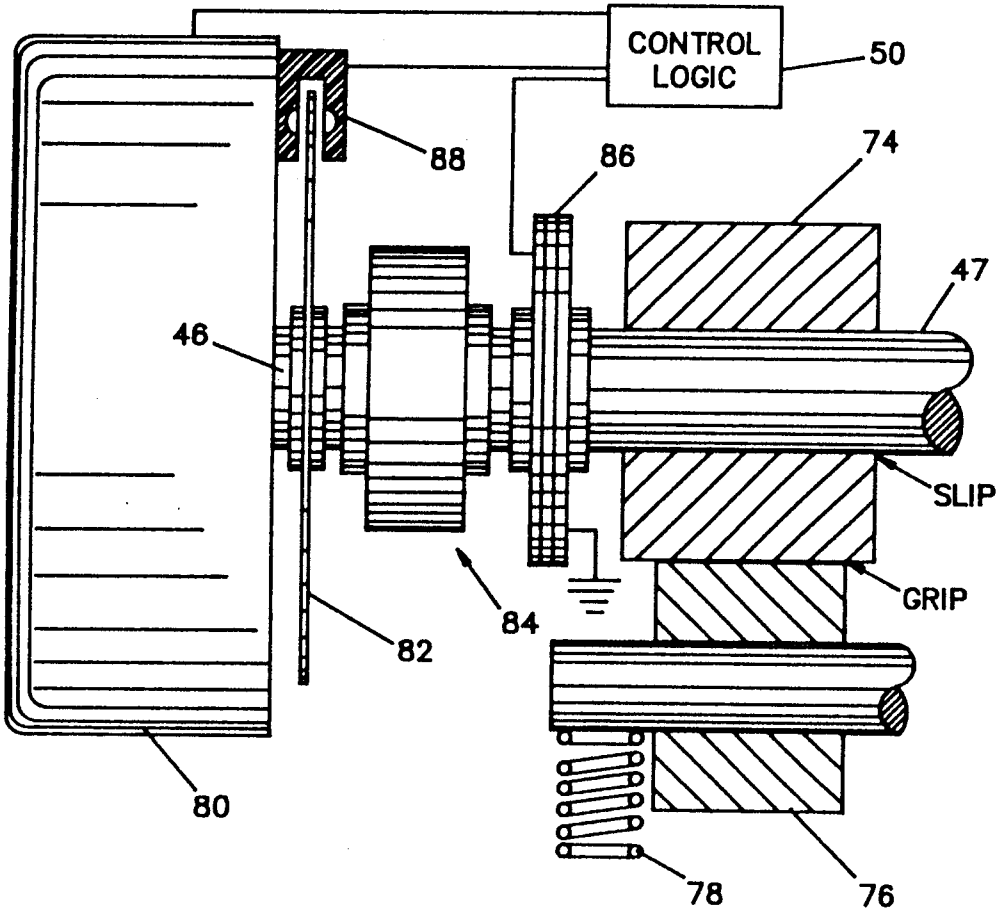
FIG. 4 is a partially cutaway front view of the feed roller drive assembly of the present invention.

The feed roller assembly 38 is best understood through simultaneous reference to FIGS. 3 and 4. A pair of rubber feed rollers 74 are mounted for rotation disposed above and parallel to the platen 22' adjacent the respective ends thereof so as to grip the side edges of the paper 12. The front edges of the rollers 74 are tangent to a plane passing substantially vertically through the printing face 56 thereof. The feed rollers 74 are resiliently slip-mounted on a shaft 47 by means of a friction or magnetic clutch (not shown). Preferably, the surface of the feed rollers 74 has an abrasive thereon to provide positive gripping of the paper for driving purposes. A pair of rubber pressure idler rollers 76 are mounted for rotation disposed parallel to the feed rollers 74 with a facing edge thereof in contact with the front edges of the rollers 74. The pressure idler rollers 76 are biased towards the feed rollers 74, such as by a pair of springs 78, so as to create a pinching force between the rollers 74, 76. As a consequence, paper 12 passing between the rollers 74, 76 is gripped between them and can only be moved by their combined rotation. Alternately, feed rollers 74 may be positively rotated by shaft 47 with slip, when required, being between the feed rollers 74 and the paper 12. Optionally, a spring pressure plate could be used in lieu of the feed rollers 76 to hold the paper against the rollers 74 for driving purposes.

One end of the shaft 47 carrying the drive rollers 74 is connected (by means to be described shortly) to the drive shaft 46 of an upper D.C. motor 80. Again, as will be appreciated by those skilled in the art, other functionally equivalent types of motors could, of course, be employed for the motor 80, e.g. stepping motors, rotary or linear solenoid motors, etc. The motor 80 is also operably connected to the control logic 50 to be operated thereby. Between the shaft 46 of the motor 80 and the end of the shaft 47 there is an optically encoded position disk 82, a backlash mechanism 84 (optional but preferred), and an electromagnetic brake 86 connected to ground potential. An optical sensor 88 is mounted to the motor 80 and connected to the control logic 50. The disk 82 is graduated to provide twenty sensible graduations per step of the motor 80. The sensor 88 and disk 82 are according to techniques well known in the art for providing a feedback of the rotational position of the motor 80 as it is stepped so as to allow the control logic 50 to accurately control the acceleration and stopping of the motor 80 in the novel manner of the present invention to be described shortly. Per se, the sensor 88 and disk 82 form no part of the novelty of the present invention and, therefore, in the interest of simplicity and the avoidance of redundancy, they will not be described further. The same is true for the electromagnetic brake 86.

Figure 5:
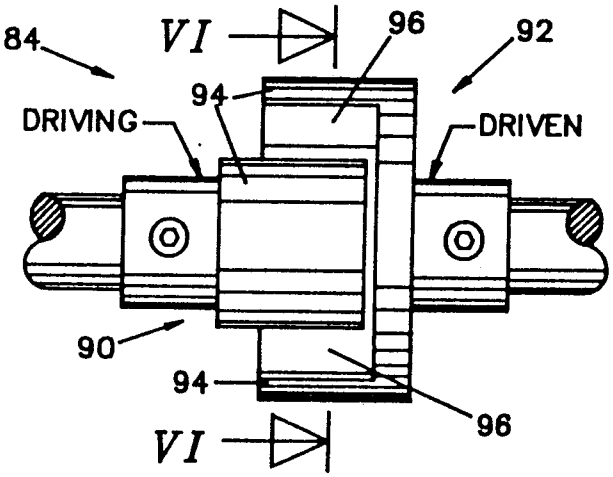
FIG. 5 is a front view of the backlash coupling device employed in the preferred embodiment of the present invention.
Figure 6:
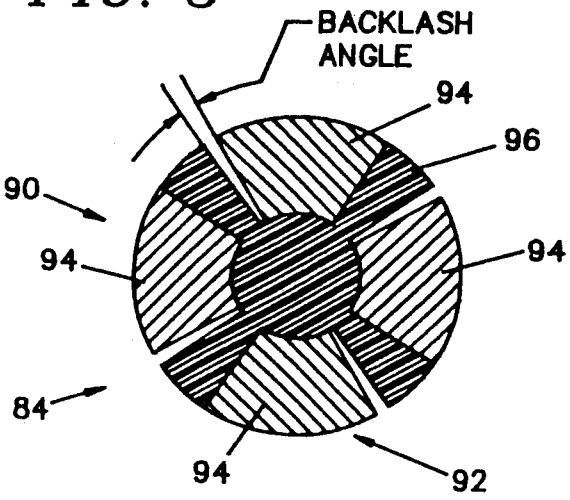
FIG. 6 is a cutaway drawing of the backlash coupling device of FIG. 5 in the plane VI-VI.

The backlash coupling mechanism 84, while not absolutely necessary for the operation of the present invention, provides superior operation and helps in the avoidance of possible problems and is, therefore, preferred. For example, when introduced in the position shown in FIG. 4, it will reduce paper line feed time approximately 25% as compared to the same system without it. As can be seen from the detailed drawings of FIGS. 5 and 6, it is similar in construction to a universal joint, i.e. comprising a driving portion 90 and a driven portion 92 each having horizontal drive fingers 94 at 180 degrees from one another with the drive fingers 94 of the driving portion 90 oriented 90 degrees from the drive fingers 94 of the driven portion 92. Instead of being connected together by rotational pins as in a universal joint (which would prevent rotational displacement, i.e. backlash, between the driving and driven portions 90, 92) the arcs between the adjacent drive fingers 94 are occupied by an impact member 96 comprising arcuate pieces of a high impact elastomeric material such as many plastics well known in the art. The arcuate pieces of the impact member 96 are of an arc distance less than the arc distance between the adjacent drive fingers 94 to provide an arcuate movement area of freeplay. This difference is the "backlash angle" as indicated in FIG. 6. In the preferred embodiment of the coupling mechanism 84, the backlash angle is provided to separate the inertia of the upper stepping motor 80 from the inertia of the feed rollers 74 driving the paper 12 to its new line position. This angular separation allows the upper stepping motor 80 to undergo a higher initial acceleration which, upon the subsequent impact of the driving portion 90 with the driven portion 92 through the impact member 96, creates a high instantaneous line feed acceleration of the feed rollers 74. To use an analogy, it acts like a hammer driving a nail. One swings the hammer, one does not hold the hammer against the nail and push. The stepping motor 80 only has to accelerate its own mass and then the driving portion 90 of the coupling mechanism 84 strikes the driven portion 92 with an impact that applies a large step acceleration force to the feed rollers 74. After each line feed has been completed, the electromagnetic brake is activated to stop the movement of the drive rollers 74 and the paper being driven thereby. Then, the upper stepping motor 80 is reversed through the freeplay area the proper number of steps towards the beginning thereof to restore the majority of the backlash angle. Like the lifting of the paper weight from the supply stack, this occurs during the printing portion of the cycle. Note that the entire backlash angle is not traversed as to do so might result in moving the paper during the printing process. Note also that the time interval required to accelerate the stepping motor 80 through the backlash angle also occurs during the printing portion of the cycle; that is, just prior to the time for line feed, the control logic 50 starts the stepping motor 80 through the backlash angle. This is timed such that the impact of the driving portion 90 with the driven portion 92 occurs exactly at the instant that line feed is desired. As a result, the line feed loop 98 is driven virtually instantaneously to its new position. As a result, it was found that paper advancement could take place as follows—1/72" in less than 0.7 ms, 5/72 " in 2 ms, and 1/6" in less than 6 ms. In passing, it should be noted that a friction clutch, or the like, is included in the resilient slip mounting of the rollers 74 on the shaft 47 so as to allow the feed rollers 74 to stop rotation when the loop 98 is removed. This prevents the rollers from spinning against the paper and the consequent loading of its surface.

Returning now to FIG. 3 with particularity, the manner of operation of the above-described apparatus under the control of the control logic 50 will now be described in detail. During the printing of a line of text on the paper 12, the logic 50 steps the lower stepping motor 48 to lift the paper 12 from the supply stack and urge a next line feed portion horizontally forward as indicated by the arrow 52. At this time, the paper is being gripped between the pressure edge 72 of the pressure plate 60 and the guide bar 54 and, therefore cannot move forward along its path of travel beyond that point. Accordingly, the paper between the tractor feed mechanism 10' and the above-described point of gripping is forced into the junction of the horizontal and vertical portions 62, 64 of the pressure plate 60 thus forming a line feed loop of the paper 12 as indicated by the dashed line 98. The paper 12 is only advanced one dot line feed distance by the motor 80 and control logic 50 and, therefore, the line feed loop 98 contains only that amount of the paper 12, i.e. a very low mass. In a tested embodiment of the present invention, the pressure of the edge 72 on the guide bar 54 is such that up to ⅛" of paper can be formed into the loop 98 without forcing paper past the platen 22'.

When it is time for a line feed of the paper 12 following the end of printing of a line of text, the control logic 50 steps the upper stepping motor 80 to lift the small mass of the paper 12 between the gripping point of contact between the rollers 74, 76 and the line feed loop 98 through the gripping force which exists between the pressure edge 72 of the pressure plate 60 and the guide bar 54. Because of the low mass being moved, there can be no overshoot and the paper 12 comes quickly to its new position as depicted by the solid lines in FIG. 3 with the paper 12 stretched across the platen. The braking effect of the gripping force which exists between the pressure edge 72 of the pressure plate 60 and the guide bar 54 prevents the line feed loop 98 from "creeping" and affecting the paper position during printing.

As those skilled in the art will appreciate, while the tractor feed mechanism of the present invention as described hereinbefore is disposed to lift the paper and advance it in a horizontal direction to form the line feed loop 98, and such an orientation is preferred, it could be oriented to lift the paper vertically and also advance it vertically. The important aspect of the present invention is the providing of the frictional gripping point between the tractor feed and the platen so that advanced paper cannot move beyond that point and, therefore, "bunches up" to form the line feed loop which is subsequently pulled through the frictional gripping point.

Figure 8:
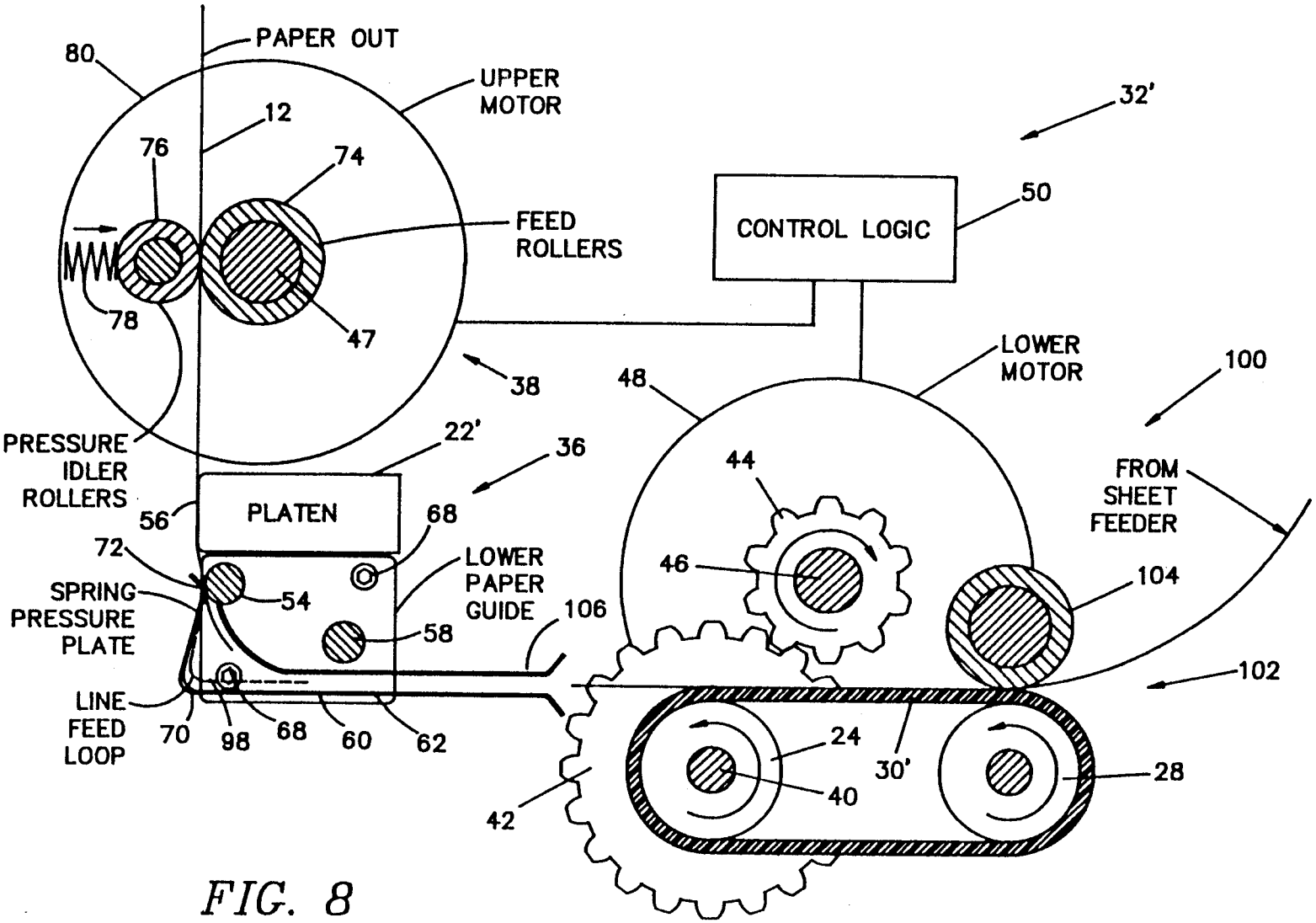
FIG. 8 is a detailed side view of the high speed paper advancing system of the present system in an alternate embodiment intended for use with cut paper sheets as fed from a sheet feeder.

While the principal application of the present invention is with continuous form paper, as mentioned earlier, there may be instances where the benefits thereof can be applied to a single sheet printer wherein the paper is input on a sheet-by-sheet basis from a sheet feeder. In such applications, the present invention could be configured as shown in FIG. 8 wherein it is generally indicated as 32'. Basically, all that has to be done is to replace the tractor feed lifting mechanism 34 with a sheet feeding mechanism such as that generally indicated as 100. The mechanism 100 is representative only and other types of paper gripping drives could, of course, be employed for the purpose. The mechanism comprises a horizontally disposed belt feed mechanism 102 generally as described above. As in the tractor feed 10', a pair of drive rollers 24 are located to be on either side of the paper 12. The drive rollers 24 are interconnected by a shaft 40 so as to move in combination. One end of the shaft 40 has a drive gear 42 concentrically mounted thereon. The drive gear 42 is operably connected to be driven by a pinion gear 44 carried by the drive shaft 46 of a lower stepping motor 48. The stepping motor 48 is controlled by control logic 50. A pair of non-toothed belts 30' are carried by the rollers 24, 28. A pair of pressure rollers 104 are rotatably mounted above the belts 30' in rolling contact therewith. Thus, independently and at the proper time (as previously described), by stepping the motor 48, the control logic 50 can independently turn the drive rollers 24, belts 30', idler rollers 28, and pressure rollers 104 in combination to receive a sheet of paper 12 from the sheet feeder (not shown) and push it horizontally toward the lower paper guide assembly 36. To assure proper paper movement on a sheet-by-sheet basis since the paper is not continuous in this application, it is anticipated that the lower paper guide assembly 36 will need to include additional paper guiding provision such as the upper guide 106.

Figure 9:
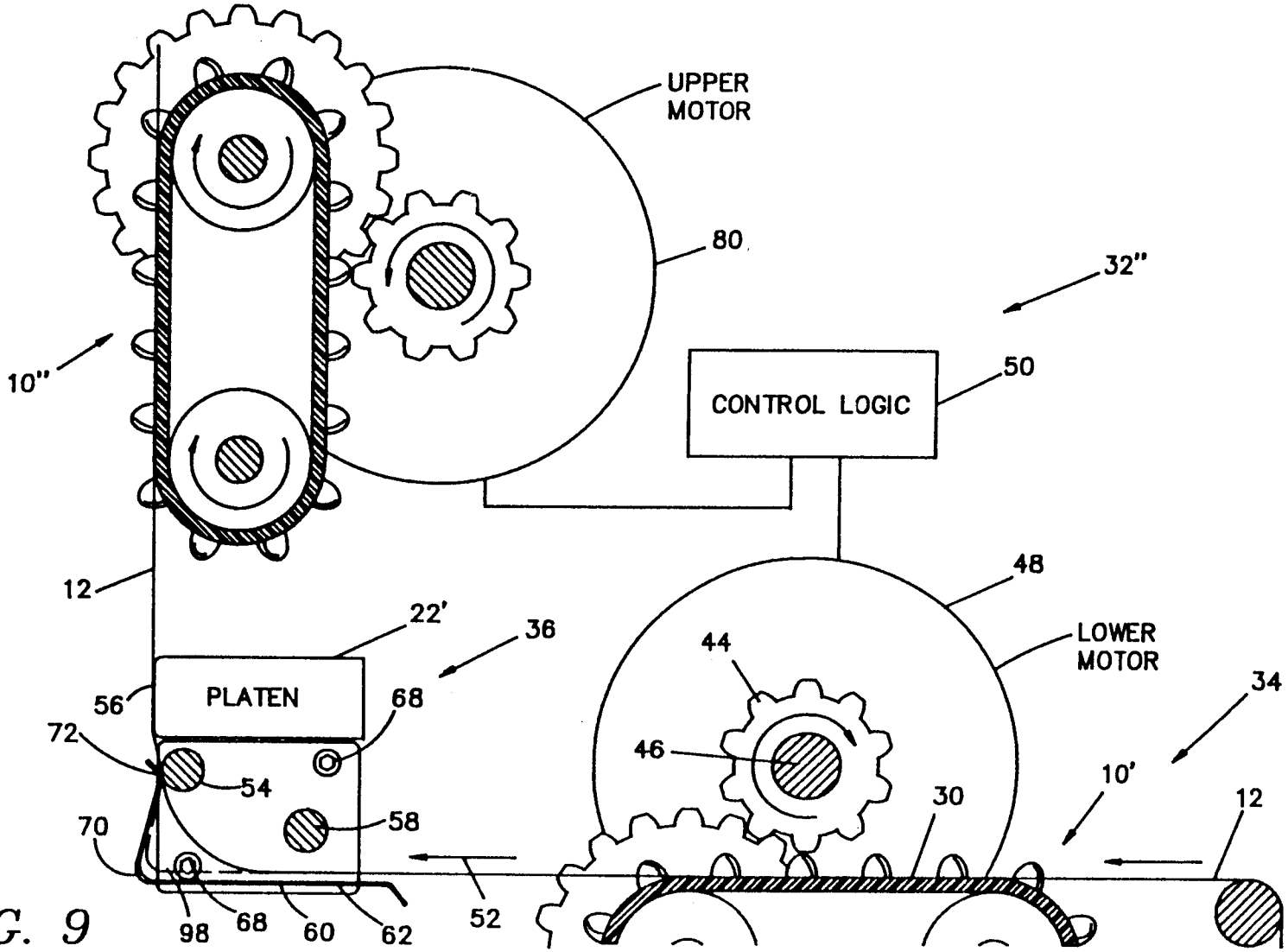
FIG. 9 is a detailed side view of a portion of the high speed paper advancing system of the present system in another alternate embodiment where the upper feed rollers have been replaced by a tractor feed mechanism.

Another possible variation of the present invention which may be desirable in some applications employing continuous form paper is depicted in FIG. 9. In this variation, labelled as 32", the upper rollers 74, 76 are replaced by tractor feeds 10" operably connected to be driven by the upper motor 80. Other types of drives as known in the art could also be substituted, if desired. Several other variations possible within the general teaching of the present invention as hereinbefore described in its preferred embodiment are also worthy of mention at this point. For one, since the amount of paper in the loop 98 available for advancement by the upper drive is metered in advance, the optical sensor 88 could be omitted if necessary. The reliability of the printer with respect to accurate line feeding could, of course, be degraded by such removal and, for that point, the inclusion of the sensor 88 is preferred.

Figure 7:
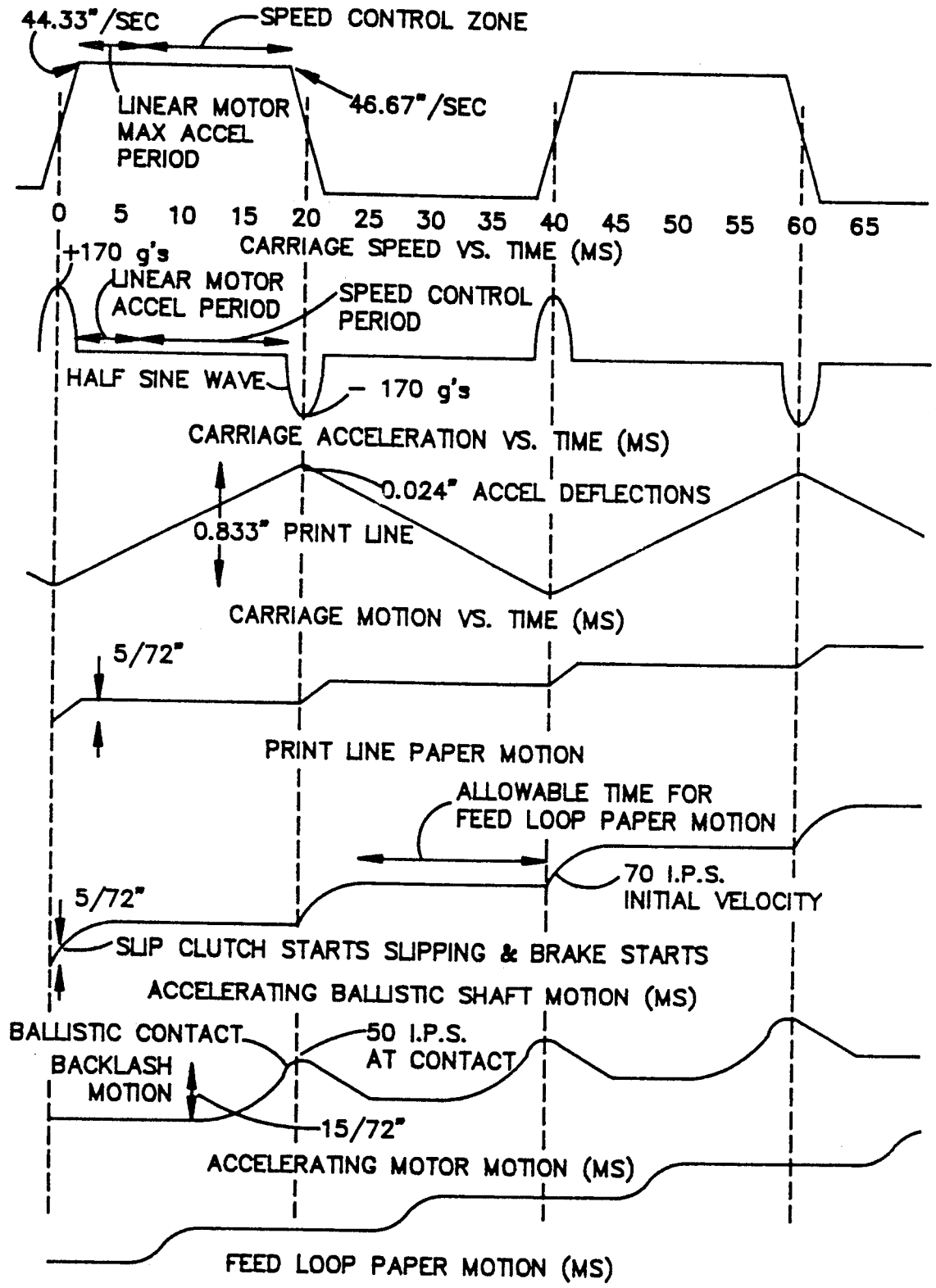
FIG. 7 is a motion and timing diagram of the operation of the present invention.

Having thus described the present invention and its manner of operation in general, the specifics of a tested embodiment thereof as incorporated into a high speed shuttle printer by the inventor herein will now be provided by way of example. The operation of the invention in the above contemplated mode is shown in FIG. 7. During the illustrated printing cycle, the lower stepping motor 48 advances the tractor feed mechanism 10' approximately 5/72". Just prior to line feed time, the upper motor 80 is accelerated to 50"/second equivalent paper speed. At impact, the feed rollers 74 accelerate the paper 12 at 140 g's until the paper's peak speed is 50"/second, after which some slowing occurs and the paper 12 moves at an average of 40"/second until the 5/72" feed loop is removed. The upper motor 80 is then decelerated by paper friction. Without the backlash coupling mechanism 84, 25"/second equivalent paper speed has been employed for a 5/72" line feed. Typical times involved in 1/6" paper motion according to the above-described scenario with the backlash coupling mechanism 84 are as follows:

Acceleration of paper to 50"/second=0.5 ms;
During this time, the paper moves 1/72"
Time to move the paper the remaining 11/72"=4.0 ms
Total Time=4.5 ms Returning again to FIG. 3 with particularity, an alternative manner of operation of the above-described apparatus under the control of the control logic 50 will now be described in detail. During or after the printing of a line of text on the paper 12, the logic 50 steps the lower stepping motor 48 to lift the paper 12 from the supply stack and advance a next line feed portion horizontally forward as indicated by the arrow 52. At the commencement of this action, the paper is being gripped between the pressure edge 72 of the pressure plate 60 and the guide bar 54 and, therefore cannot move forward along its path of travel beyond that point. Accordingly, the paper between the tractor feed mechanism 10' and the above-described point of gripping is forced into the junction of the horizontal and vertical portions 62, 64 of the pressure plate 60 thus initiating the formation of a line feed loop of the paper 12 as indicated by the dashed line 98. The paper 12 is only advanced one dot line feed distance by the motor 80 and control logic 50.

When it is time for a line feed of the paper 12 following the end of printing of a line of text, the control logic 50 steps the upper stepping motor 80 to lift the small mass of the paper 12 between the gripping point of contact between the rollers 74, 76 and the line feed loop 98 through the gripping force which exists between the pressure edge 72 of the pressure plate 60 and the guide bar 54. Because of the low mass being moved, there can be no overshoot and the paper 12 comes quickly to its new position as depicted by the solid lines in FIG. 3 with the paper 12 stretched across the platen.

In this alternative manner of operation the control logic 50 initiates the stepping of the upper stepping motor 80 after the lower stepping motor 48 has commenced advancing paper 12 but before the lower stepping motor 48 has completed the advancement of the next line feed portion to the line feed loop. The control logic 50 times the operation of the lower stepping motor 48 so that advancement of the entire next line feed portion of the paper 12 to the line feed loop is completed no later than the completion of the lifting of the entire next line feed portion of the paper 12 from the line feed loop past the pressure edge 72 of the pressure plate 60 and the guide bar 54. By virtue of this, the line feed loop, in this alternative manner of operation, never, in normal operation, contains an entire next line feed portion of paper 12 and the mass of paper to be lifted by the upper stepping motor 80 is thereby reduced.

Thus it can be seen that the present invention has met its stated objective by providing a paper advancing apparatus and associated method of operation which will advance paper line-by-line quickly and accurately in very high speed printing operations.

We claim:

1. A paper advancing mechanism for a printer, for printing lines of text, including a horizontal platen and a printing mechanism disposed adjacent the platen for printing lines of text during side to side motion thereof with an interval between the printing of successive lines during which the printing mechanism reverses direction, the paper advancing mechanism being for intermittently moving paper on a line-by-line basis, an exact length from a supply input, between the platen and printing mechanism comprising:

a) powered first drive means disposed before the platen and printing mechanism for receiving and gripping the paper from the supply input and for advancing an exact length of paper for exactly one or a multiple of one line feed distance to a supply loop between said powered first drive means and the platen and printing mechanism subsequent to commencement of the printing of a line by said printing mechanism;

b) powered second drive means disposed after the platen and printing mechanism for gripping and rapidly moving the paper only said exact length from said supply loop between said powered first drive means and the platen and printing mechanism during a single said interval, said powered second drive means being inoperative to move said paper, while said printing mechanism is printing a line; and, c) control logic means operably connected to said powered first drive means and said powered second drive means for activating said second drive means to move all of paper from said supply loop thereby to advance said exact length of the paper past the platen and printing mechanism when the printing mechanism has completed printing a line and requires the paper to be so advanced in preparation for the printing of the next line and for activating said first drive means, to receive and advance only said exact length of paper from the supply input to said supply loop subsequent to the printing mechanism commencing the printing of said line and in time to enable the moving of said exact length of paper from said supply loop by said second drive means, whereby said second drive means has only to move the minimum mass of paper needed for the advance of said exact length.

2. A paper advancing mechanism according to claim 1 comprising:

frictional gripping means disposed adjacent the platen between the platen and said first drive means for frictionally gripping the paper under a gripping force sufficient to prevent advancement beyond said frictional gripping means by said first drive means while permitting the paper to be pulled through said frictional gripping means by said second drive means.

3. The paper advancing mechanism of claim 1 comprising frictional gripping means disposed adjacent the platen between the platen and said first drive means for frictionally gripping the paper under a gripping force sufficient to prevent advancement beyond said frictional gripping means by said first drive means while permitting the paper to be pulled through said frictional gripping means by said second drive means wherein, said second drive means provides sufficient drive to overcome the frictional grip of said frictional gripping means while providing insufficient drive to overcome the combined resistance, to movement of the paper, provided by the said first drive means and said frictional gripping means.

4. A paper advancing mechanism according to claim 1 wherein said second drive means includes frictional slip means providing sufficient frictional drive for said rapid moving of the paper from the supply loop between the platen and printing mechanism while providing insufficient frictional drive to overcome the resistance, to movement of the paper, provided by said first drive means.

5. A paper advancing mechanism according to claim 1 wherein said control logic means activation of said second drive means occurs while said first drive means is advancing said exact length of paper to said supply loop and said activation of said first drive means is timed to ensure that said advancement of said exact length of paper to said supply loop is completed no later than the completion of the advancement of said exact length of paper past the platen and printing mechanism.

6. A paper advancing mechanism according to claim 1 wherein said control logic means is operably connected to said powered first drive means and said powered second drive means for activating said first drive means, to receive only exactly the paper from the supply input required to form said supply loop, during the time the printing mechanism is printing a line and for activating said second drive means to move the paper said exact length of said supply loop when the printing mechanism has completed printing a line and requires the paper to be advanced said exact length in preparation for the printing of the next line.

7. A paper advancing mechanism according to claim 1 wherein said powered second drive means comprises:

a) a pair of feed rollers mounted for rotation and disposed parallel to the platen adjacent respective side edges of the paper;

b) a pair of pressure idler rollers mounted for rotation and disposed parallel to respective ones of said feed rollers in contacting relationship thereto;

c) means for urging said pressure idler rollers against said feed rollers to create a gripping force therebetween for frictionally gripping the paper under a gripping force sufficient to pull the paper through said frictional gripping means;

d) a drive motor operably connected to said feed roller and said control logic means;

wherein said feed roller is concentrically attached to the end of a drive shaft of said drive motor to rotate in combination therewith; and e) an electromagnetic brake disposed between said feed roller and said end of said drive shaft of said second drive motor.

8. A paper advancing mechanism according to claim 1 wherein said powered second drive means comprises:

a) a pair of feed rollers mounted for rotation and disposed parallel to the platen adjacent respective side edges of the paper;

b) a pair of pressure idler rollers mounted for rotation and disposed parallel to respective ones of said feed rollers in contacting relationship thereto;

c) means for urging said pressure idler rollers against said feed rollers to create a gripping force therebetween for frictionally gripping the paper under a gripping force sufficient to pull the paper through said frictional gripping means;

d) a drive motor operably connected to said feed roller and said control logic means;

wherein said feed roller is concentrically attached to the end of a drive shaft of said second drive motor to rotate in combination therewith; and e) a backlash coupling mechanism having an arc of freeplay motion disposed between said feed roller and said end of said drive shaft of said second drive motor; and f) said control logic means includes means for backing up said drive motor to a point towards the beginning of said freeplay during the time the printer is printing a line of text and for starting said second drive motor in a forward direction at a time prior to the time said upper drive means is to move the paper from said supply loop said feed distance such that said freeplay is exhausted at the time said upper drive means is to move the paper from said supply loop said feed distance.

9. A paper advancing mechanism according to claim 1 wherein said powered second drive means comprises:

a) a pair of feed rollers mounted for rotation and disposed parallel to the platen adjacent respective side edges of the paper;

b) a pair of pressure idler rollers mounted for rotation and disposed parallel to respective ones of said feed rollers in contacting relationship thereto;

c) means for urging said pressure idler rollers against said feed rollers to create a gripping force therebetween for frictionally gripping the paper under a gripping force sufficient to pull the paper through said frictional gripping means;

d) a drive motor operably connected to said feed roller and said control logic means; and e) said feed roller is resiliently slip mounted on a shaft concentrically attached to the end of a drive shaft of said drive motor to rotate in combination therewith.

* * * * *